US006975280B2

(12) United States Patent
Jenwatanavet

(10) Patent No.: US 6,975,280 B2
(45) Date of Patent: Dec. 13, 2005

(54) MULTICOIL HELICAL ANTENNA AND METHOD FOR SAME

(75) Inventor: Jatupum Jenwatanavet, San Diego, CA (US)

(73) Assignee: Kyocera Wireless Corp., San Diego, CA (US)

( * ) Notice: Subject to any disclaimer, the term of this patent is extended or adjusted under 35 U.S.C. 154(b) by 0 days.

(21) Appl. No.: 10/189,094

(22) Filed: Jul. 3, 2002

(65) Prior Publication Data

US 2004/0004581 A1 Jan. 8, 2004

(51) Int. Cl.[7] ..... H01Q 1/36
(52) U.S. Cl. ..... 343/895; 343/702
(58) Field of Search ..... 343/895, 853, 343/702; 455/550, 899

(56) References Cited

U.S. PATENT DOCUMENTS 5,179,387 A * 1/1993 Wells ..... 343/895
5,909,196 A * 6/1999 O'Neill, Jr. ..... 343/895
5,963,871 A * 10/1999 Zhinong et al. ..... 455/550
6,201,500 B1 * 3/2001 Fujikawa ..... 343/702
6,375,479 B1 * 4/2002 Johnson et al. ..... 439/131
6,501,437 B1 * 12/2002 Gyorko et al. ..... 343/895
6,734,831 B2 * 5/2004 Makino ..... 343/895

* cited by examiner

*Primary Examiner*—James Vannucci

(57) ABSTRACT

A helical antenna is provided that simultaneously resonates at a plurality of frequencies. This antenna comprises a first coil having a first end for termination in a transmission line feed port. A second coil has a first end connected to the first coil second end, and an unterminated second end. In some aspects, a third coil is used, connected to the second coil second end, with an unterminated end. The coils have axial lengths, a wire gauge, and a coil diameter. The axial lengths are approximately equal to a number of turns times a spacing between turns. In addition, the antenna further comprises a first dielectric encompassed by the first and second coils and a second dielectric that encompasses the first and second coils. The antenna resonates at a first frequency and a second frequency, non-harmonically related to the first frequency, in response to the first and second coils.

4 Claims, 4 Drawing Sheets

MULTICOIL HELICAL ANTENNA AND METHOD FOR SAME

BACKGROUND OF THE INVENTION

1. Field of the Invention

This invention generally relates to wireless communication antennas and, more particularly, to a dual coil helical antenna for communicating at a pair of frequencies, and a method for the same.

2. Description of the Related Art

Wireless communications devices, a wireless telephone or laptop computer with a wireless transponder for example, are known to use simple cylindrical coil antennas as either the primary or secondary communication antennas. The resonance frequency of the antenna is responsive to its electrical length, which forms a portion of the operating frequency wavelength. The electrical length of a wireless device helical antenna is often a ratio such as $3\lambda/4$, $5\lambda/4$, or $\lambda/4$, where $\lambda$ is the wavelength of the operating frequency, and the effective wavelength is responsive to the dielectric constant of the proximate dielectric.

Wireless telephones can operate in a number of different frequency bands. In the US, the cellular band (AMPS), at around 850 megahertz (MHz), and the PCS (Personal Communication System) band, at around 1900 MHz, are used. Other frequency bands include the PCN (Personal Communication Network) at approximately 1800 MHz, the GSM system (Groupe Speciale Mobile) at approximately 900 MHz, and the JDC (Japanese Digital Cellular) at approximately 800 and 1500 MHz. Other bands of interest are global positioning satellite (GPS) signals at approximately 1575 MHz and Bluetooth at approximately 2400 MHz.

Wireless devices that are equipped with transponders to operate in multiple frequency bands must have antennas tuned to operate in the corresponding frequency bands. Equipping such a wireless device with discrete antennas for each of these frequency bands is not practical as the size of these devices continues to shrink, even as more functionality is added. Nor is it practical to expect users to disassemble devices to swap antennas. Even if multiple antennas could be designed to be collocated, so as to reduce the space requirement, the multiple antenna feed points, or transmission line interfaces still occupy valuable space. Further, each of these discrete antennas may require a separate matching circuit.

For example, an antenna can be connected to a laptop computer PCMCIA modem card external interface for the purpose of communicating with a cellular telephone system at 800 MHz, or a PCS system at 1900 MHz. A conventional single-coil helical antenna is a good candidate for this application, as it is small compared to a conventional whip antenna. The small size would make the helical antenna easy to carry when not attached to the laptop, and unobtrusive when deployed. The single-coil helical antenna has a resonant frequency and bandwidth that can be controlled by the diameter of coil, the spacing between turns, and the axial length, as is well known. However, such a single-coil helical antenna will only operate at one of the frequencies of interest, requiring the user to carry multiple antennas, and also requiring the user to make a determination of which antenna to deploy.

It would be advantageous if a helical coil antenna could be designed to operate at more than one operating frequency.

SUMMARY OF THE INVENTION

The present invention describes a multicoil helical antenna having a single feedpoint that operates at a plurality of non-harmonically related frequency bands. More specifically, the antenna includes a plurality of series-connected helical coils. Accordingly, a helical antenna is provided that simultaneously resonates at a plurality of frequencies. This antenna comprises a first coil having a first end for termination in a transmission line feed port. A second coil has a first end connected to the first coil second end, and an unterminated second end. In some aspects, a third coil is used, connected to the second coil second end, with an unterminated end.

The first coil has an axial length approximately equal to a number of turns times the spacing between turns. The wire gauge and the coil diameter also effect tuning. Likewise, the second coil has an axial length, a wire gauge, and a coil diameter. Typically, the axial lengths, the number of turns, and turn spacing of the two coils are different. However, wire gauge and coils diameters are often the same.

In addition, the antenna further comprises a first dielectric encompassed by the first and second coils and a second dielectric that encompasses the first and second coils. A first conductor, with a length and a wire gauge, connects the two coils. A second conductor, with a length and a wire gauge, connects the transmission line feed point to the first coil.

The antenna resonates at a first frequency and a second frequency, non-harmonically related to the first frequency, in response to the first and second coils. In some aspects, the first frequency is a band of frequencies in the range of approximately 824 to 894 MHz and the second frequency is a band of frequencies in the range of 1850 to 1990 MHz.

Additional details of the above-mentioned antenna, and a method for forming a helical antenna with a plurality of operating frequencies, are provided below.

DETAILED DESCRIPTION OF THE PREFERRED EMBODIMENTS

Figure 1:
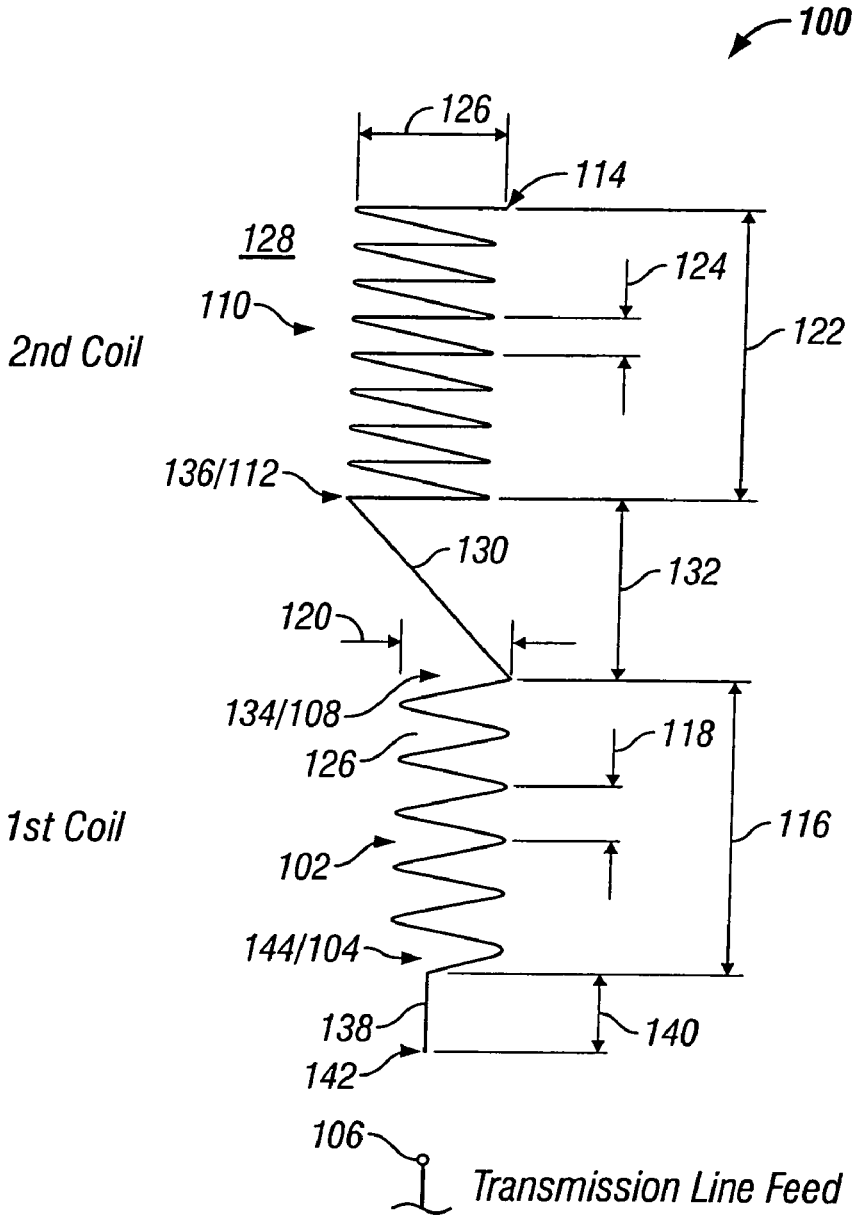
FIG. 1 is a diagram of an exemplary version of the present invention helical antenna that simultaneously resonates at a plurality of frequencies.

FIG. 1 is a diagram of a helical antenna that simultaneously resonates at a plurality of frequencies. The antenna 100 comprises a first coil 102 having a first end 104 for termination in a transmission line feed port 106 and a second end 108. A second coil 110 has a first end 112 connected to the first coil second end 108 and an unterminated second end 114. The helical antenna 100 resonates at a first frequency in response to the first and second coils 102/110. Further, the antenna 100 resonates at a second frequency, non-harmonically related to the first frequency, in response to the first and second coils 102/110.

Figure 2:
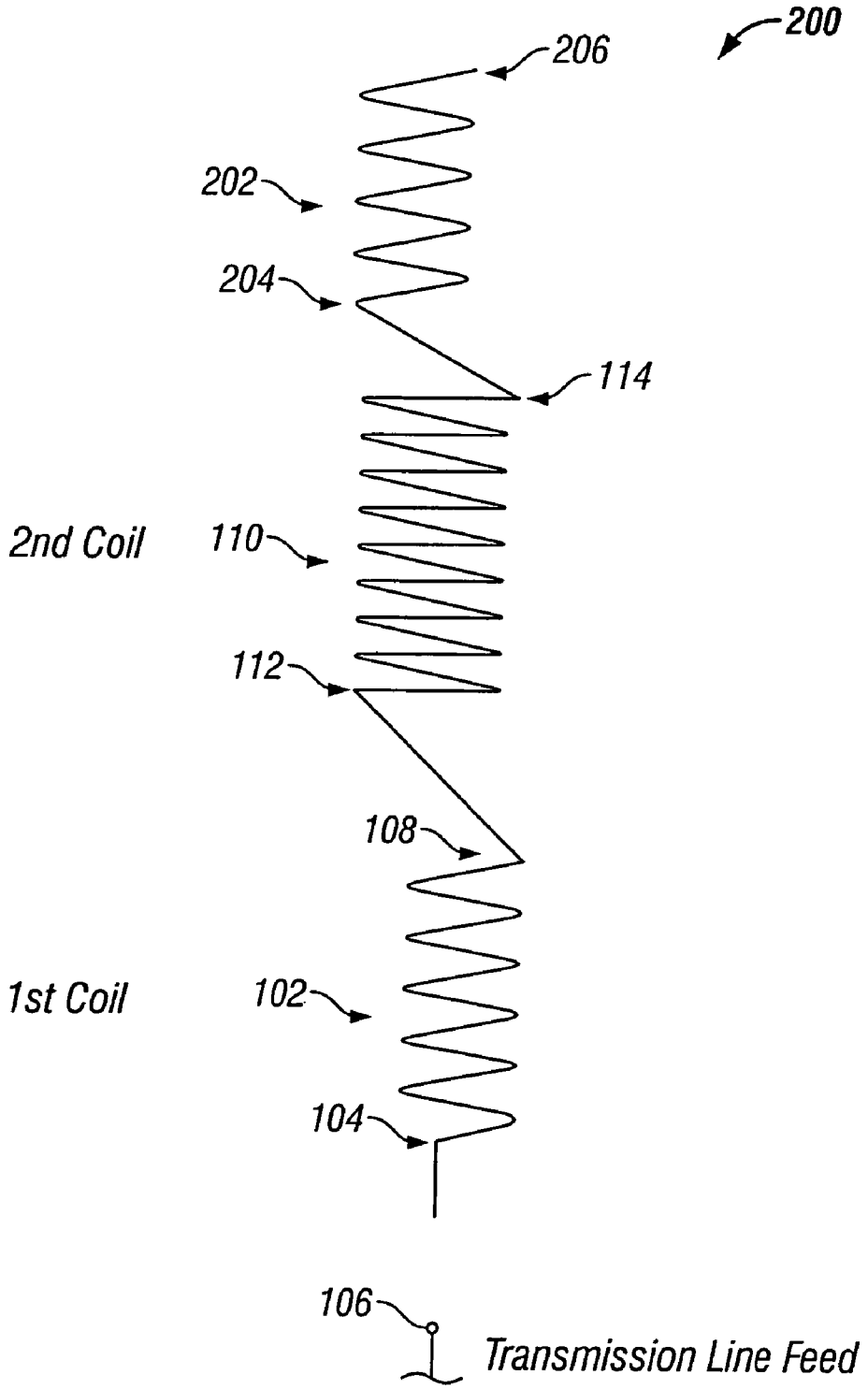
FIG. 2 illustrates an exemplary three-coil version of the present antenna.

FIG. 2 illustrates an exemplary three-coil version of the present antenna. The antenna 200 of FIG. 2 includes all the elements of the antenna of FIG. 1, which will not be repeated in the interest of brevity, plus a third coil 202, having a first end 204 connected to the second coil second end, and an unterminated second end. Alternately stated, the helical antenna 100 or 200 comprises a plurality of series connected coils having a transmission line feed first end and a second, unterminated end. As shown in FIG. 1, the plurality equals two. As shown in FIG. 2, the plurality equals three. Whatever number the plurality equals, the antenna resonates at that number (the plurality) of non-harmonically related frequencies. Although examples of two and three coils have been shown, any practical number of coils is possible.

Returning to FIG. 1, the first coil 102 has an axial length 116 approximately equal to a number of turns times a spacing between turns 118. The first coil 102 is also defined by the wire gauge and a coil diameter 120. Likewise, the second coil 110 has an axial length 122 approximately equal to a number of turns times a spacing between turns 124. The second coil is also defined by a wire gauge and a coil diameter 126.

As shown in the example of FIG. 1, the first coil axial length 116 does not equal the second coil axial length 122. Further, the first coil 102 number of turns does not equal the second coil 110 number of turns. Neither does the first coil turn spacing 118 equal the second coil turn spacing 124. These differences between the two coils exist to tune a specific pair of frequencies, or frequency bands. However, the above-mentioned inequalities need not exist. For example, in some aspects, the two coils may have the same axial length, or the same number of coils, or the same turn spacings. Alternately, the axial lengths may be the same with a different number of coils and different turn spacings.

Typically, for ease of manufacturing, the first coil diameter 120 equals the second coil diameter 126, as they can be wound around the same structure. However, the two diameters need not be equal in all aspects of the invention. It is also typical that the first coil 102 wire gauge is the same as the second coil 110 wire gauge. Again, the relationship need not always be true, as at least one extra step of fabrication is required, to join the two gauges of wire, if different wire gauges are used.

The helical antenna 100 further comprises a first dielectric 126 having a dielectric constant. The first and second coils 102/110 encompass the first dielectric 126. A second dielectric 128, having a dielectric constant, encompasses the first and second coils 102/110. As shown, the first and second dielectrics could be a medium such as air. Alternately, the coils can be embedded in an initially liquid dielectric medium that is hardened in and around the coils, such as a foam.

Figure 3A:
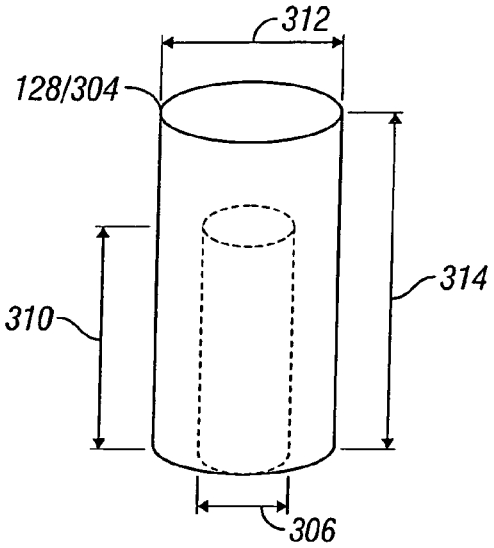
FIG. 3 is a diagram illustrating a variation on the first and second dielectrics of FIG. 1.
Figure 3B:
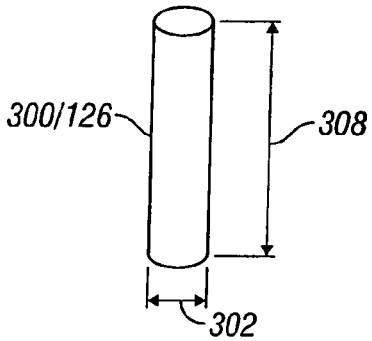

FIG. 3 is a diagram illustrating a variation on the first and second dielectrics 126/128 of FIG. 1. Shown, the first dielectric 126 is a solid cylinder 300 of material, such as Delrin, having a diameter 302. Also, shown is the second dielectric 128 as a hollow cylinder 304 of material, such as Delrin, having an inside diameter 306. Many other materials besides Delrin are known in the art, with different dielectric constants. The arrangement of cylinders as shown permits the first and second coils to be wound around cylinder 300 during fabrication. The hollow cylinder 304 acts as a cap to protect the coils from being inadvertently bent out of shape.

To continue the example of FIG. 1, the cylinder 300 has a diameter 302 of approximately 2.32 millimeters (mm), a length 308 of 31 mm, and a dielectric constant of 3.7. The hollow cylinder of 304 has an inside diameter 306 of 3.75 mm, an inside length 310 of 31 mm, an outside diameter 312 of 6.65 mm, an outside length 314 of 36 mm, and a dielectric constant of 3.7. Although the above example uses a common material for both the first and second dielectric material, in other aspects of the antenna different materials, with different dielectric constants, are used.

Returning to FIG. 1, the antenna 100 further comprises a first conductor 130 that has a length 132, a wire gauge, a first end 134 connected to first coil second end 108, and a second end 136 connected to the second coil first end 112. A second conductor 138 has a length 140, a wire gauge, a first end 142 connected to the transmission line feed point 106, and a second end 144 connected to the first coil first end 104.

To continue the example of FIG. 1, the first coil axial length 116 equals 11 mm, the number of turns is equal to 5, the turn spacing 118 equals 2.2 mm. The first coil 102 wire gauge is 22 AWG, and the coil diameter 120 is approximately 2.32 mm. The second coil 110 has an axial length 122 of 8 mm, 10 turns, and a turn spacing 124 equal to 0.8 mm. The second coil wire gauge is 22 AWG and the coil diameter 126 is approximately 2.32 mm. To further continue the example of FIG. 1, the first conductor 130 has a length 132 of 7.5 mm and a 22 wire gauge. The second conductor 138 has a length 140 of 10 mm and 22 wire gauge. It should be understood that many of these measurements are approximate. For example, an exact number of turns, an exact turn spacing, and an exact axial length necessarily vary with fabrication tolerances.

To complete the example of FIG. 1, the first frequency is a band of frequencies in the range of approximately 824 to 894 MHz and the second frequency is a band of frequencies in the range of 1850 to 1990 MHz. The example of FIG. 2, with three coils, could permit an antenna to resonant at the two above-mentioned frequencies with the addition of frequencies in the band between 1565 and 1585 MHz, to accept GPS signals. Other variations of the antenna could be tuned to resonate at the above-mentioned frequencies, and additionally at 2400 to 2480 MHz to support Bluetooth communications.

Figure 5:
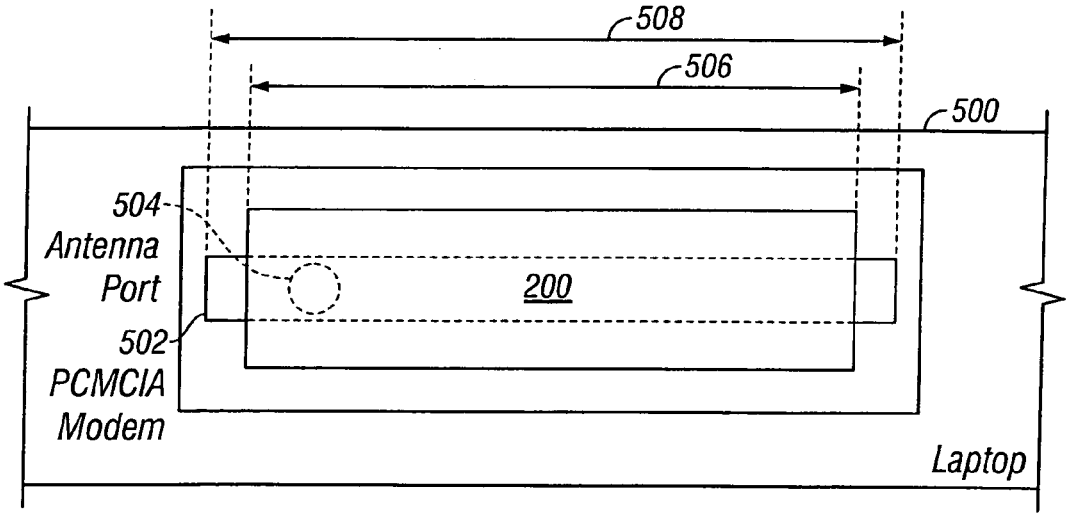
FIG. 5 is a side view of a conventional laptop computer utilizing the present invention dual coil helical antenna.

FIG. 5 is a side view of a conventional laptop computer utilizing a dual coil helical antenna. In some aspects, the helical antenna 200 is used in a wireless communications system comprising a microprocessor subsystem 500, such as a laptop computer (as shown) or a dedicated function microprocessor device. A Personal Computer Memory Card International Association (PCMCIA) modem 502, depicted with dashed lines behind the antenna 200, is connected to the microprocessor subsystem 500, and has an antenna port 504 suitable for wireless communications. PCMCIA modem cards have a rectangular size of 85.6 by 54 millimeters.

The helical antenna 200 is connected the PCMCIA modem antenna port 504 for communication in the above-mentioned frequency bands. The antenna fits within the form factor of a standard PCMCIA modem. That is, the length 506 of the antenna 200 is less than the width 508 of the conventional PCMCIA modem card 202. Conventional modem cards have a standard width, connector, and form factor to mate into the provided slots of a conventional laptop computer.

The above-described double-coil example has a single feed point. The two coils are connected to each other by a straight wire. The separation offered by the connecting wire (first connector) can act to decouple the two coils, permitting greater control in coil tuning, to achieve the desired two resonant frequencies. The diameter of coils, spacing between turns, and axial length for both coils can be varied to support alternate applications. In tuning, both coils have a significant impact on the two resonant frequencies. The spacing between turns in the first coil has a significant impact on the higher (second) resonant frequency; the larger the spacing, the lower the second resonant frequency. The spacing between turns in the second coil has an impact on both the first and second frequencies; the larger the spacing, the lower the first resonant frequency, but the higher the second resonant frequency. A smaller separation between two coils (a shorter first conductor) moves the resonant frequencies of both bands higher. Further, a larger number of turns in either coil, lowers both resonant frequencies.

Figure 4:
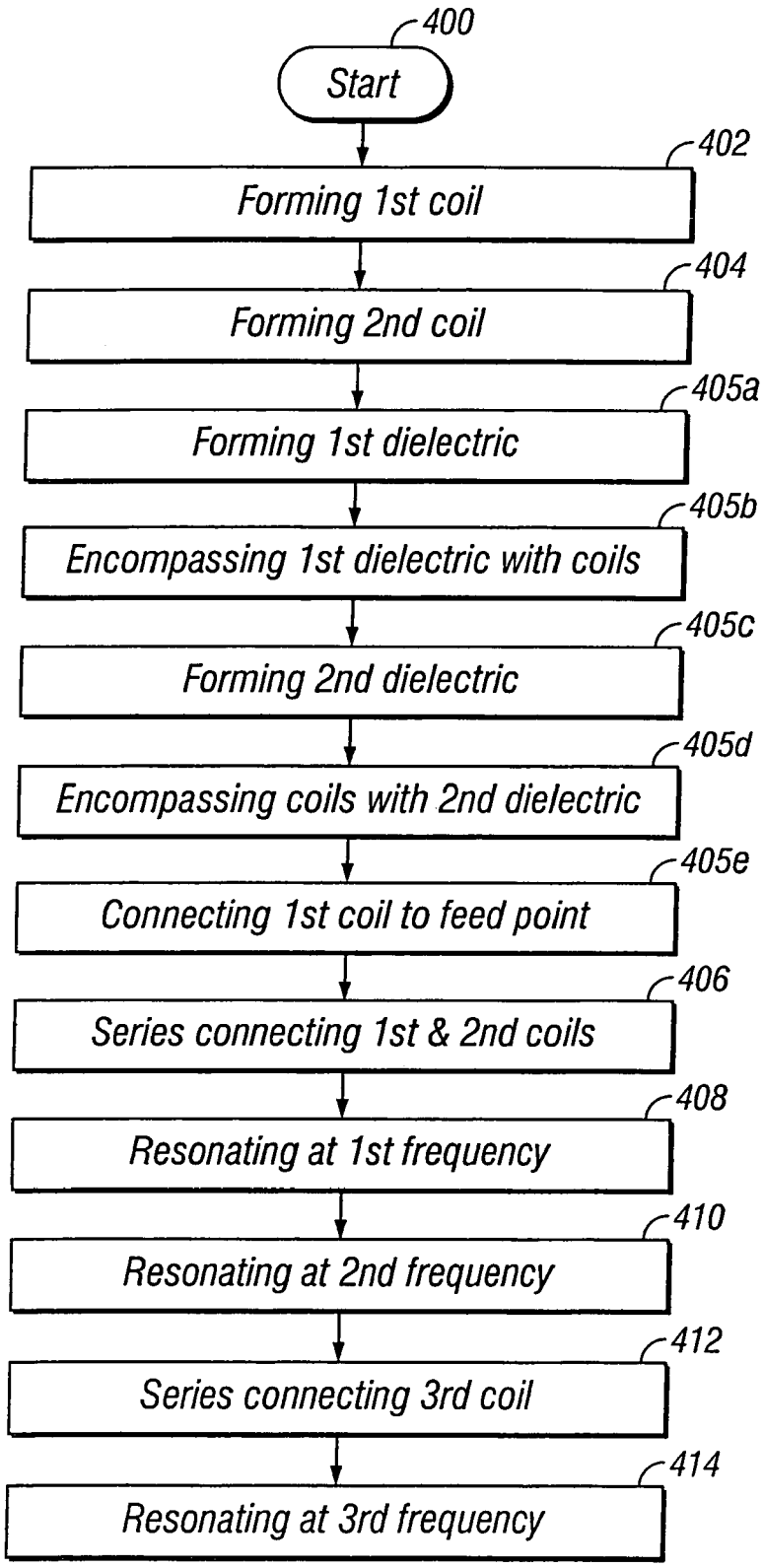
FIG. 4 is a flowchart illustrating the present invention method for forming a helical antenna with a plurality of operating frequencies.

FIG. 4 is a flowchart illustrating a method for forming a helical antenna with a plurality of operating frequencies. Although this method is depicted as a sequence of numbered steps for clarity, no order should be inferred from the numbering unless explicitly stated. It should be understood that some of these steps may be skipped, performed in parallel, or performed without the requirement of maintaining a strict order of sequence. The method starts at Step 400. Step 402 forms a first coil of wire having an axial length approximately equal to a number of turns times a spacing between turns. The first coil is formed with a wire gauge and a coil diameter. Step 404 forms a second coil of wire having an axial length approximately equal to a number of turns times a spacing between turns. The second coil is formed from a wire gauge and a coil diameter. Step 406 series connects the first coil of wire to the second coil of wire. Step 408 resonates at a first frequency. Step 410 simultaneously resonates at a second frequency, non-harmonically related to the first frequency.

In some aspects of the method, forming the first and second coils of wire in Steps 402 and 404 includes the first coil axial length not being equal the second coil axial length, the first coil number of turns not being equal the second coil number of turns, and the first coil turn spacing not being equal the second coil turn spacing. In other aspects, forming the first and second coils of wire in Steps 402 and 404 includes the first coil diameter being equal to the second coil diameter and the first coil wire gauge being equal to the second coil wire gauge.

Some aspects of the method include further steps. Step 405*a* forms a first dielectric having a dielectric constant. Step 405*b* encompasses the first dielectric with the first and second coils of wire. Step 405*c* forms a second dielectric having a dielectric constant. Step 405*d* encompasses the first and second coils of wire with the second dielectric.

In some aspects, series connecting the first and second coils in Step 406 includes connecting the first and second coils of wire with a first conductor having a length and a wire gauge. In other aspects, Step 405*e* connects the first coil of wire to a transmission line feed point with a second conductor having a length and a wire gauge.

In one example of the method, forming the first coil of wire in Step 402 includes forming the first coil with an axial length equal to 11 millimeters (mm), a number of turns equal to 5, a turns spacing equal to 2.2 mm, a 22 wire gauge, and a coil diameter of approximately 2.32 mm. Likewise, forming the second coil of wire in Step 404 includes forming the second coil with an axial length of 8 mm, a number of turns equal to 10, a turn spacing equal to 0.8 mm, a 22 wire gauge, and a coil diameter of approximately 2.32 mm.

To continue the example, forming the first dielectric in Step 405*a* includes forming a solid cylinder of Delrin having a diameter of 2.32 mm, a length of 31 mm, and a dielectric constant of 3.7. Forming the second dielectric in Step 405*c* includes forming a hollow cylinder of Delrin having an inside diameter of 3.75 mm an inside length of 31 mm, an outside diameter of 6.65 mm, an outside length of 36 mm, and a dielectric constant of 3.7.

Further continuing the example, forming the first conductor in Step 406 includes forming a conductor with a length of 7.5 mm and a 22 wire gauge. Forming the second conductor in Step 405*e* includes forming a conductor with a length of 10 mm and a 22 wire gauge.

To complete the example, resonating at a first frequency in Step 408 includes resonating at a frequency band in the range of approximately 824 to 894 megahertz (MHz). Resonating at a second frequency in Step 410 includes resonating at a frequency band in the range of approximately 1850 to 1990 MHz.

In some aspects of the method forming the second coil in Step 404 includes increasing the coil turn spacing. Then, resonating at a first frequency in Step 408 includes resonating at a first, lower frequency in response to increasing the second coil turn spacing. Resonating at a second frequency in Step 410 includes resonating at a second, higher frequency in response to increasing the second coil turn spacing;

In other aspects, forming the second coil in Step 404 includes decreasing the number of turns. Then, resonating at a first frequency in Step 408 includes resonating at a first, higher frequency in response to decreasing the number of second coil turns. Step 410 resonates at a second, higher frequency in response to decreasing the number of second coil turns.

In some aspects, forming the first coil in Step 402 includes increasing the turn spacing. Then, resonating at a second frequency in Step 410 includes resonating at a second, lower frequency in response to increasing the first coil turn spacing.

In other aspects, forming the first conductor in Step 406 includes forming a first conductor with a shorter length. Then, resonating at a first frequency in Step 408 includes resonating at a first, higher frequency in response to increasing the first conductor shorter length. Resonating at a second frequency in Step 410 includes resonating at a second, higher frequency in response to increasing the first conductor shorter length.

In another aspects of the method a further step, Step 412, series connects a third coil of wire to the first and second coils of wire. Then, Step 414 resonates a third frequency non-harmonically related to the first and second frequencies.

A multicoil helical antenna has been presented. A couple of examples have been presented to clearly illustrate and define the invention. However, the invention is not limited to the presented number of coils or coil geometries. Neither is the present invention limited to the example frequency ranges or frequencies exclusively devoted for use with wireless telephone transceivers. Other variations and embodiments of the invention will occur to those skilled in the art.

I claim:

1. A wireless communications system comprising:

a microprocessor subsystem;

a Personal Computer Memory Card International Association (PCMCIA) modem card having a first port connected to the microprocessor subsystem, an antenna port, and a card width; and, a dual coil helical antenna connected to the PCMCIA modem antenna port and including a first coil having a first end for termination in a transmission line feed port and a second end, and a second coil having a first end connected to the first coil second end and an unterminated second end, the antenna having a length that is less than the PCMCIA card width.

2. The wireless communications system of claim 1, further comprising:

a microprocessor subsystem coupled to the first port.

3. The system of claim 1 wherein the antenna resonates at a first frequency in response to the first and second coils; and, wherein the antenna resonates at a second frequency, non-harmonically related to the first frequency, in response to the first and second coils.

4. The system of claim 2 wherein the first frequency is a band of frequencies in the range of approximately 824 to 894 megahertz (MHz) and the second frequency is a band of frequencies in the range of 1850 to 1990 MHz.

* * * * *